US006718780B2

(12) United States Patent
Cho et al.

(10) Patent No.: US 6,718,780 B2
(45) **Date of Patent: *Apr. 13, 2004**

(54) CONCENTRATION COOLING APPARATUS FOR REFRIGERATOR

(75) Inventors: Seong-Ho Cho, Seoul (KR); In-Seop Lee, Gyeonggi-Do (KR); In-Won Lee, Gyeonggi-Do (KR); Jae-Yong Sung, Seoul (KR); Jay-Ho Choi, Seoul (KR); Kwang-Hyup An, Seoul (KR); Jeong-Ho Lee, Gyeonggi-Do (KR); Young-Sok Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/331,489

(22) Filed: Dec. 31, 2002

(65) Prior Publication Data

US 2004/0016249 A1 Jan. 29, 2004

(30) Foreign Application Priority Data

Jul. 24, 2002 (KR) ..... 2002/43655

(51) Int. Cl.[7] ..... F25D 17/08; F25D 17/04; F25B 5/00

(52) U.S. Cl. ..... 62/186; 62/408

(58) Field of Search ..... 62/186, 407, 408

(56) References Cited

U.S. PATENT DOCUMENTS

| | | | | | |
|---|---|---|---|---|---|
| 4,002,199 | A | * | 1/1977 | Jacobs | 165/61 |
| 5,884,496 | A | * | 3/1999 | Kim et al. | 62/186 |
| 5,899,090 | A | * | 5/1999 | Lyu | 62/408 |
| 5,974,814 | A | * | 11/1999 | Park et al. | 62/151 |
| 6,073,458 | A | * | 6/2000 | Kim | 62/186 |
| 6,401,481 | B2 | * | 6/2002 | Hiraoka et al. | 62/407 |
| 2003/0029178 | A1 | * | 2/2003 | Zentner et al. | 62/186 |

* cited by examiner

*Primary Examiner*—Willaim C. Doerrler
(74) *Attorney, Agent, or Firm*—Greenblum & Bernstein, P.L.C.

(57) ABSTRACT

A concentration cooling apparatus for a refrigerator includes a housing which is mounted in a cold air guiding path, and a nozzle which is rotatably supported in the housing, for concentratedly injecting cold air to a region where a high temperature load is generated when the high temperature load is generated in a predetermined region inside a cooling chamber. An infrared sensor is mounted at the front of the nozzle, for sensing the region where the high temperature load is generated. The sensor rotates together with the nozzle and a frost drying sensor is installed on the upper surface of the nozzle, for drying frost on the surface of the infrared sensor. Thus, the reliability of the infrared sensor can be improved by preventing the formation of frost on the surface of the lens of the infrared sensor which detects whether the high temperature load is generated.

10 Claims, 8 Drawing Sheets

CONCENTRATION COOLING APPARATUS FOR REFRIGERATOR

BACKGROUND OF THE INVENTION

1. Field of the Invention

The present invention relates to a refrigerator which performs a swift cooling operation of a high temperature load by concentratedly injecting cool air into a region where a high temperature load is generated inside the chilling chamber and particularly, to a concentration cooling apparatus for a refrigerator, capable of preventing attaching of frost on the surface of the infrared sensor.

2. Description of the Background Art

FIG. 1 is a partially sectional perspective view showing a conventional refrigerator.

The conventional refrigerator includes a main body 104, having a receiving space therein, a freezing chamber 106 which is positioned at the left side of the main body 104, for keeping frozen food, a cooling chamber 108 divided from the freezing chamber 106 by partition wall 110, for keeping refrigeration food, and a cold air supplying apparatus which is installed at the upper side of the freezing chamber 106, for supplying air which is cooled passing a freezing cycle (not shown) to the freezing chamber 106 and cooling chamber 108.

The cold air supplying apparatus includes a blower 120 which is mounted on the upper of the freezing chamber 106 and forcibly ventilating air cooled while passing the freezing cycle, a cold air path 132 which is formed at the upper side of the partition wall 110 for flowing cold air ventilated from the blower 120 to the cooling chamber 108, a cold air discharging duct 134 which is mounted at the upper portion of the cooling chamber 108 and is connected to the cold air supply path 132, and in which a cold air discharging port 136 for discharging cold air supplied to the cold air supply path 132 into the cooling chamber 108, and a cold air path 138 which is formed at the lower side of the partition wall 110, and in which cold air which completed cooling operation circulating in the cooling chamber 108 is flowed into the freezing cycle.

However, in the above conventional refrigerator, the cold air discharging duct was positioned at the upper side of the cooling chamber, and cold air was supplied from the upper side to the lower side of the cooling chamber through the discharging port formed in the cold air discharging duct. Therefore, temperature deviation was increased according to the distance from the cold air discharging port, and when a high temperature load was generated by receiving food and the like inside the cooling chamber since the cold air was discharged just from the cold air discharging duct of the cooling chamber, it took much time to have uniform temperature inside the cooling chamber. Accordingly, cooling time was lengthened and freshness of the food stored inside the cooling chamber was decreased.

SUMMARY OF THE INVENTION

Therefore, an object of the present invention is to provide a concentration cooling apparatus for a refrigerator, capable of uniformly maintaining temperature of a cooling chamber in a short time by concentratedly discharging cold air to a high temperature load generated inside the cooling chamber by installing a concentration cooling apparatus inside the cooling chamber, improving cooling speed of the high temperature load, and improving freshness of the cooling chamber.

Also, another object of the present invention is to provide a concentration cooling apparatus for a refrigerator, capable of improving reliability of an infrared sensor by preventing frost on the lens surface of the infrared sensor which detects whether the high temperature load is generated.

To achieve these and other advantages and in accordance with the purpose of the present invention, as embodied and broadly described herein, there is provided a concentration cooling apparatus for a refrigerator, including a housing which is respectively mounted in a cold air guiding path, a nozzle which is rotably supported in the housing, for concentratedly injecting cold air to a region where a high temperature load is generated when the high temperature load is generated in a predetermined region inside a cooling chamber, an infrared sensor which is mounted at the front of the nozzle, for sensing the region where the high temperature load is generated rotating together with the nozzle and a frost drying unit which is installed on the upper surface of the nozzle, for drying frost attached on the surface of the infrared sensor.

The nozzle of the concentration cooling apparatus includes a cold air injection port for injecting cold air supplied to the cold air guiding path to the region where the concentrated load is generated, and a sensor receiving groove for receiving the infrared sensor therein.

The frost drying unit includes an infrared transmission window which is attached on the surface of the nozzle, for covering the sensor receiving groove, a frost drying member which is positioned to be contacted on the surface of the infrared transmission window, for drying frost which is attached on the surface of the infrared transmission window when the nozzle rotates and a control means for rotating the nozzle when frost is attached on the infrared transmission window.

The infrared transmission window of the frost drying unit is formed in a shape of an arc so that it can be attached along the surface of the nozzle, and a through hole is formed so that cold air can pass a portion where the cold air injection port is formed.

The frost drying member of the frost drying unit is contacted on the surface of the infrared transmission window being fixed on the inner wall of the cooling chamber, and the end portion that is contacted on the infrared transmission window is formed in a shape of a concave surface to be abutted on the surface of the infrared transmission window.

The end portion that is contacted on the infrared transmission window of the frost drying member is formed with rubber material which can easily dry frost by being abutted on the surface of the infrared transmission window.

The end portion that is contacted on the infrared transmission window of the frost drying member is formed with a material having predetermined elasticity.

The end portion that is contacted on the infrared transmission window of the frost drying member is positioned in the vertical direction to the rotation direction of the nozzle.

The control means of the frost drying unit of the present invention includes a door opening/closing sensor for sensing whether the door of the refrigerator is opened or closed and a control unit for rotating the nozzle by driving the second nozzle driving portion according to an electric signal applied from the door opening/closing sensor.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

As the embodiment of the refrigerator having a concentration cooling apparatus in accordance with the present invention, there can be a plurality of embodiments and hereinafter, the most preferred embodiment will be described.

Figure 1:
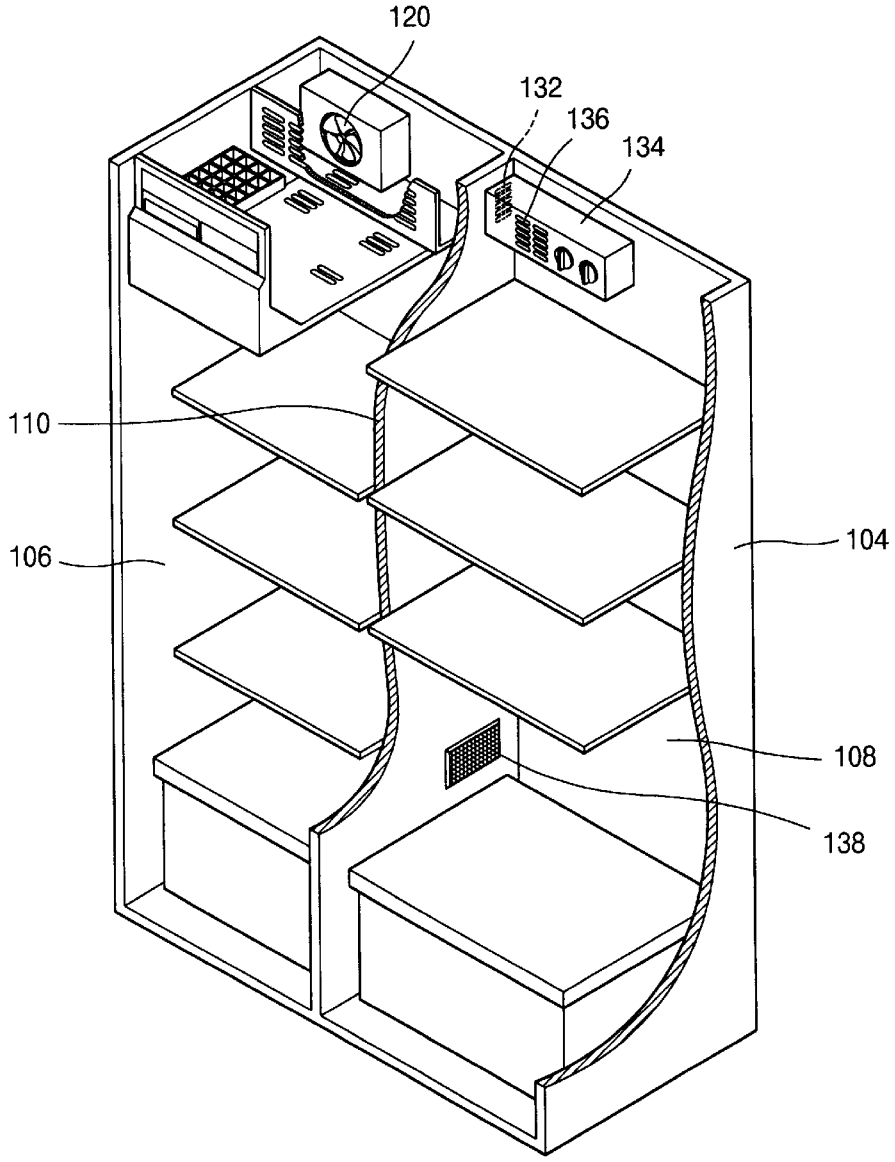
FIG. 1 CONVENTIONAL ART
FIG. 1 is a partially sectional perspective view showing a conventional refrigerator.
Figure 2:
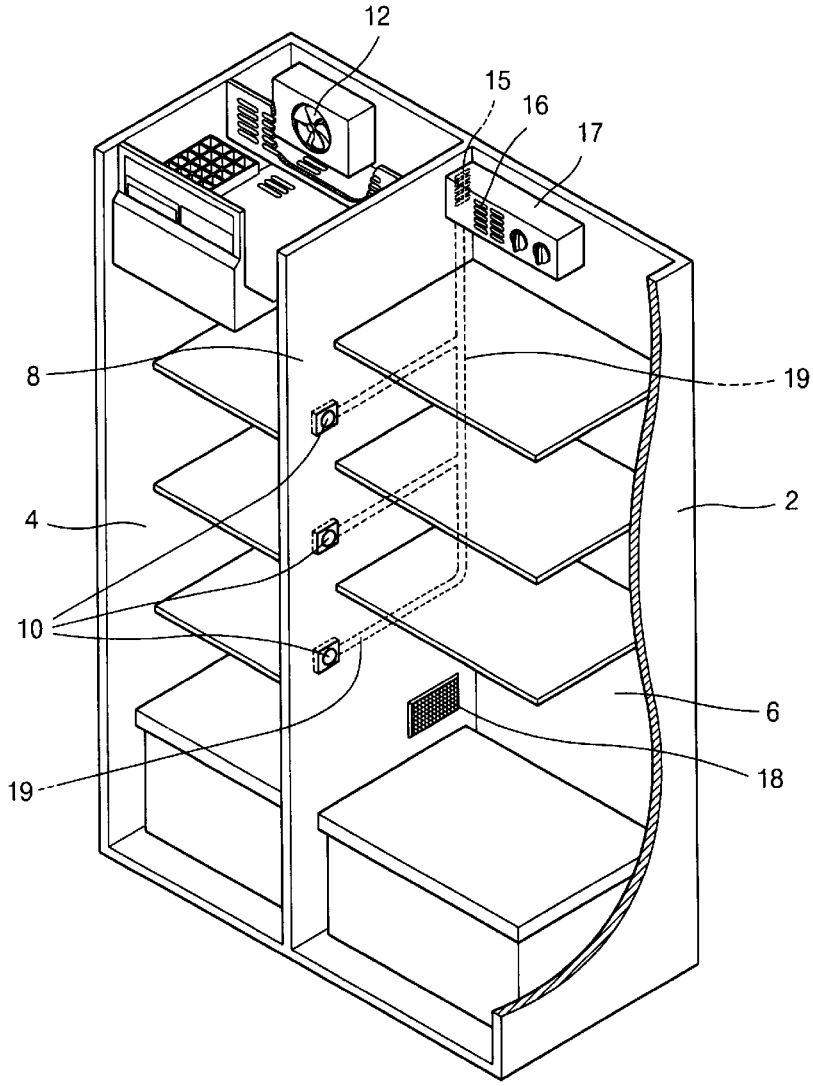
FIG. 2 is a partially sectional perspective view showing a refrigerator including a concentration cooling apparatus in accordance with the present invention.

FIG. 2 is a partially sectional perspective view showing a refrigerator including a concentration cooling apparatus in accordance with the present invention.

The refrigerator of the present invention includes a main body 2 which has a receiving space for storing food therein, a blower 12 which is attached on the upper of the freezing chamber 4 which is positioned at the right side of the main body 2, for blowing the cold air which is cooled passing the freezing cycle, a cold air supplying path 15 which is formed at the upper of the partition wall 8 which divides the freezing chamber 4 and the cooling chamber 6 for supplying cold air ventilated from the blower 12 to the cooling chamber 6, a cold air discharging duct 17 in which a cold air discharging port 16 which is connected to the cold air supply path 15 and is mounted at the upper portion of the cooling chamber 6 to discharge cold air into the cooling chamber 6, is formed, and a concentration cooling apparatus 10 for concentratedly discharging cold air to a region where a high temperature load is generated when the high temperature load is generated in a predetermined region inside of the cooling chamber 6.

Figure 3:
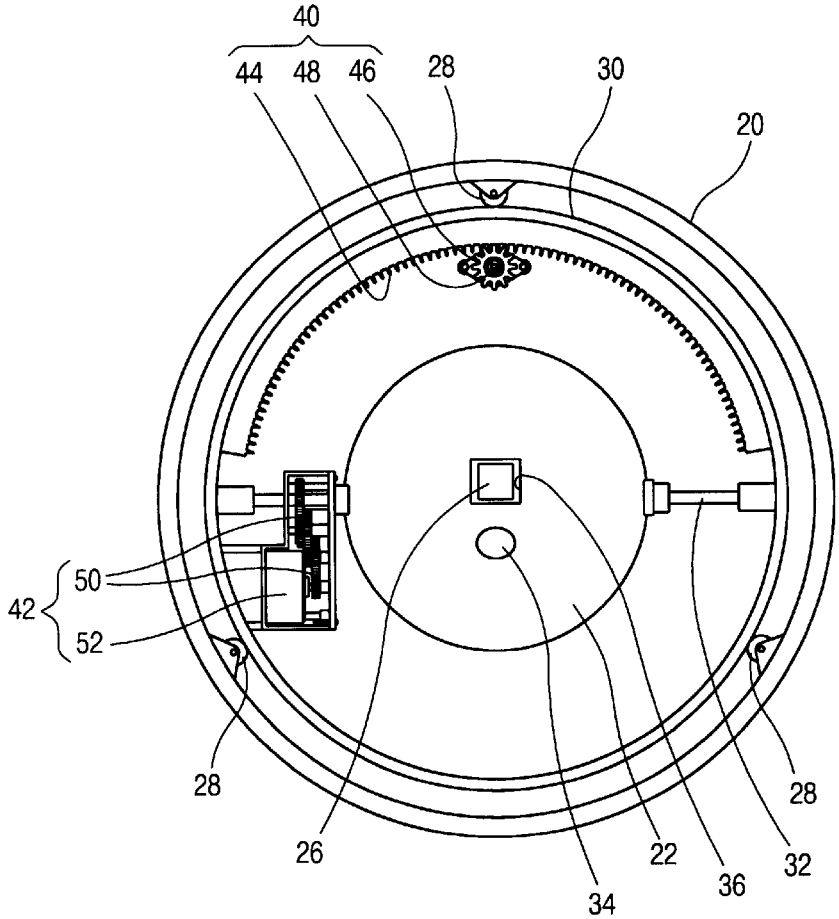
FIG. 3 is a front view showing the concentration cooling apparatus in accordance with the present invention.
Figure 4:
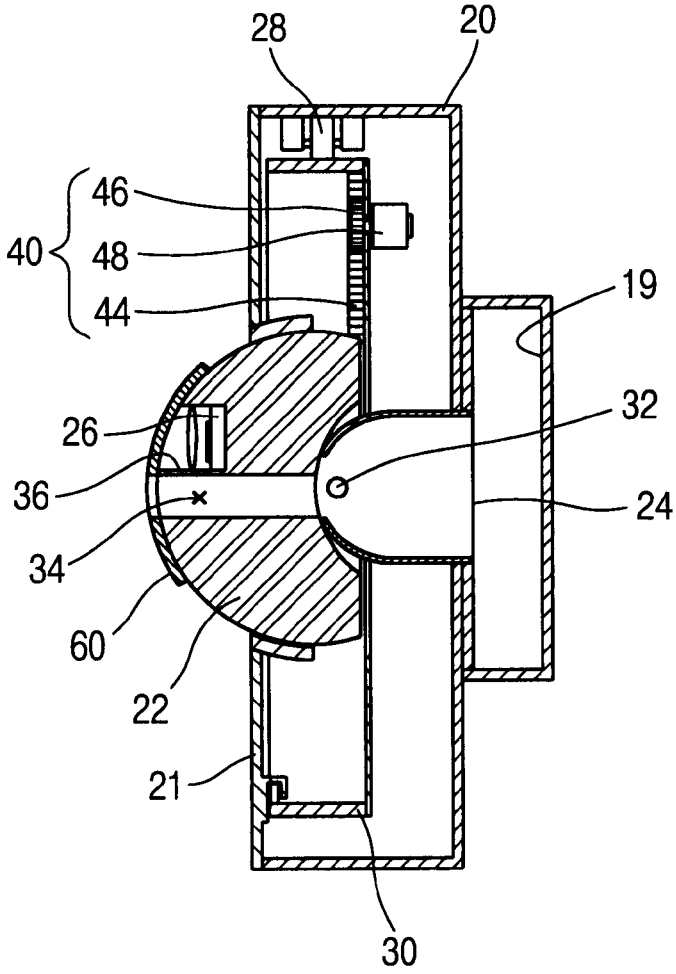
FIG. 4 is a cross-sectional view showing the concentration cooling apparatus in accordance with the present invention.

FIG. 3 is a front view showing the concentration cooling apparatus in accordance with the present invention and FIG. 4 is a cross-sectional view showing the concentration cooling apparatus in accordance with the present invention.

The concentration cooling apparatus 10 includes a cold air guiding path 19 which is extended in the cold air supplying path 15, and at least one or more of which are formed on the side wall of the cooling chamber 6 to guide the cold air to the side wall of the cooling chamber 6, having a plurality of cold air guiding holes 24 to which the cold air is supplied, a housing 20 which is respectively mounted in a cold air guiding path, a nozzle 22 which is rotably supported in the housing 20, for concentratedly injecting cold air to a region where a high temperature load is generated when the high temperature load is generated in a predetermined region inside a cooling chamber, an infrared sensor 26 which is mounted at the front of the nozzle, for sensing the region where the high temperature load is generated rotating together with the nozzle, a frost drying sensor which is installed on the upper surface of the nozzle, for drying frost attached on the surface of the infrared sensor, a first nozzle driving portion 40 for moving the nozzle 22 in the circumferential direction, and a second nozzle driving portion 42 for moving the nozzle 22 in the direction of the radius.

The upper side of the housing 20 is opened in a cylindrical shape, and the lower surface is opened to be connected with the cold air guiding hole 24. On the inner circumferential surface, supporting rollers 28 for rotably supporting the nozzle 22 are installed at a regular interval, and a cover 21 is mounted on the opened upper surface.

The nozzle 22 is formed in the hemispheric shape and is connected with the nozzle supporting member 30 which is rotably supported on the inner circumferential surface of the housing 20 by the connection rod 32. In the nozzle 22, a cold air injection port 34 for injecting cold air to a region where the high temperature load is generated is penetrated and formed, and a sensor receiving groove 36 in which the infrared sensor 26 is inserted is formed on the upper surface of the nozzle 22.

Here, the sensor receiving groove 36 is inserted in the infrared sensor 26 and an infrared lens 38 for refracting the infrared ray transmitted so that the infrared ray can be converged on the infrared sensor 26 at the front of the infrared sensor 26.

The first nozzle driving portion 40 includes a rack gear 44 which is mounted in the inner circumferential surface of the nozzle supporting member 30, a pinion gear 46 which is in gear with the rack gear 44, and a step motor 48 for driving the pinion gear 46. As the pinion gear rotates by driving the step motor 48, the nozzle supporting member 30 rotates, and the nozzle 22 connected by the nozzle supporting member 30 and connection rod 32 is rotated in the circumferential direction.

The second nozzle driving portion 42 includes a plurality of gears 50 which are installed at a side of the connection rod 32 and are mutually in gear with each other, and a step motor which is connected with the gears, for rotating the gears, and it drives the nozzle 22 in the direction of the diameter.

A frost drying unit for drying frost which is condensed on the surface of the infrared lens 38 is installed on the upper surface of the nozzle 22.

Figure 5:
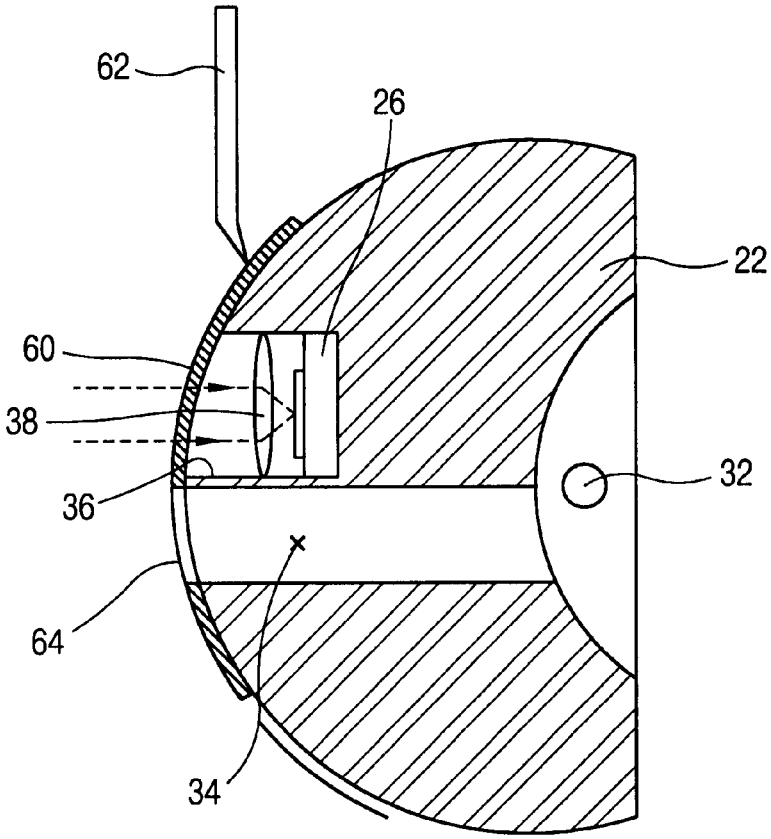
FIG. 5 is a cross-sectional view showing a frost drying unit of an infrared sensor of the concentration cooling apparatus in accordance with an embodiment of the present invention.
Figure 6:
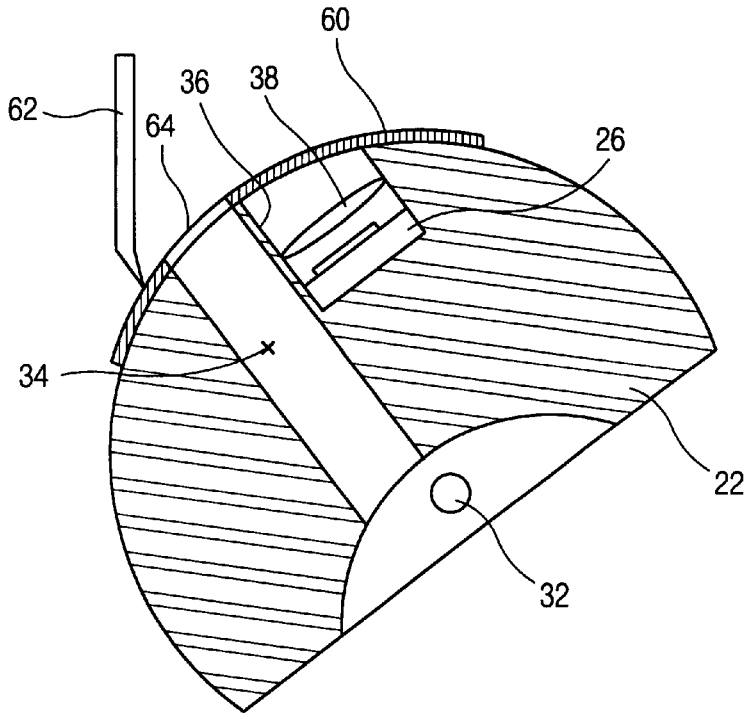
FIG. 6 is an operational view of the frost drying unit of an infrared sensor of the concentration cooling apparatus in accordance with the embodiment of the present invention.

FIG. 5 is a cross-sectional view showing a frost drying unit in accordance with an embodiment of the present invention and FIG. 6 is an operational view of the frost drying unit in accordance with the embodiment of the present invention.

The frost drying unit includes an infrared transmission window 60 which is attached on the surface of the nozzle 22, a frost drying member 62 which is positioned to be contacted on the infrared transmission window 60, for drying frost which is condensed on the surface of the infrared transmission window 60 when the nozzle 22 is rotated, and a control means for driving the nozzle 22 after a predetermined time after the door of the cooling chamber is opened and closed.

The infrared transmission window 60 is formed in the shape of an arc to be attached along the surface of the nozzle 22, and a through hole 64 is formed in a portion where the cold air injection port 34 is formed so that the cold air can flow.

In frost drying member 62, one side is fixed with an inner wall surface of the cooling chamber or a side of the housing 20, and is contacted on the surface of the infrared window 60 being extended to the portion where the infrared transmission window 60 is positioned. The end portion which is contacted on the infrared transmission window 60 of the frost drying member 62 is formed in the shape of a concave surface to be abutted on the surface of the infrared transmission window 60.

In addition, it is desirable that the end portion which is contacted on the infrared transmission window 60 of the frost drying member 62 is formed with a rubber material or a predetermined elastic body which can easily dry frost being abutted on the surface of the infrared transmission 60.

Figure 7:
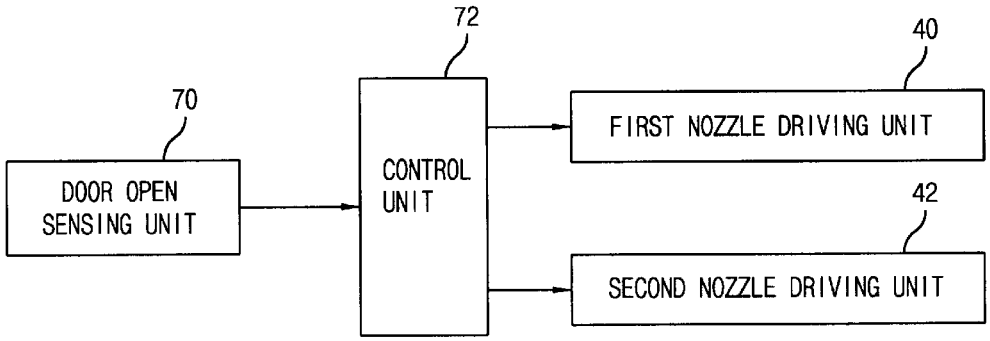
FIG. 7 is a block diagram showing a control unit of the frost drying unit in accordance with the embodiment of the present invention.

As shown in FIG. 7, the control means includes a door opening/closing sensing unit 70 for sensing whether the door of the cooling chamber is opened or closed, and a control unit 72 for rotating the nozzle 22 by driving the first and second nozzle driving portion 40 and 42 according to the electric signal applied from the door opening/closing sensing unit 70.

That is, the control means senses whether the door of the cooling chamber is opened or closed in the door opening/closing sensor unit 70 and applies the result to the control unit 72, and the control unit 72 drives the first and second nozzle driving portions 40 and 42, thus to rotate the nozzle 22 in the direction of the radius.

The operation of the concentration cooling apparatus in accordance with the present invention with the above composition will be described as follows.

When the high temperature load is generated in a predetermined region inside the refrigerator in normally operating the refrigerator, the infrared sensor 26 senses the region where the high temperature load was generated by scanning temperature of the inside of the cooling chamber 6. When the sensor applies the result to a control unit (not shown), the control unit rotates the cold air injection port 34 of the nozzle 22 to direct to the corresponding region by controlling the first and second nozzle driving portions 40 and 42, and performs concentration cooling to the region where the high temperature load was generated, thus to swiftly have the temperature inside the cooling chamber 6 uniform.

In case the door of the refrigerator is opened and closed in such operation, high temperature air of the outside is flowed into the refrigerator and when the high temperature air is cooled inside the refrigerator, moisture contained in the air is condensed and attached on the surface of the inside of the cooling chamber. At this time, in case the moisture is attached on the surface of the infrared sensor 26, sensitivity of the infrared sensor is decreased, and accordingly, it is impossible to accurately measure temperature. To prevent this, when the door is opened and closed, the frost drying unit is operated and removes the frost which is condensed on the surface of the infrared sensor 26.

In the operation of the frost drying unit, when the door of the refrigerator is opened and closed, the door opening/closing sensing portion 70 senses this, and applies it to the control unit 72. Then, the control unit 72 determines that moisture is condensed on the surface of the infrared transmission window which is attached on the nozzle 22, and rotates the nozzle 22 in the direction of the radius by driving the first and second nozzle driving portions 40 and 42. The infrared transmission window 60 attached on the upper surface of the nozzle 22 rotates together. At this time, the frost drying means 62 which is abutted on the surface of the infrared transmission window 60 removes frost condensed on the infrared transmission window 60.

Figure 8:
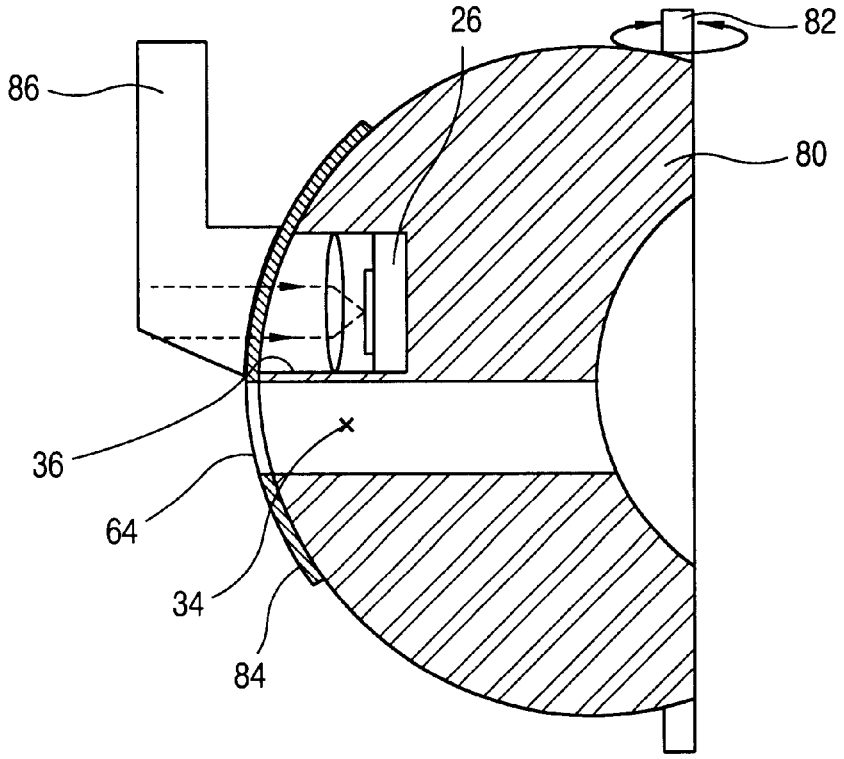
FIG. 8 is a cross-sectional view showing a frost drying unit of an infrared sensor of the concentration cooling apparatus in accordance with another embodiment of the present invention.

FIG. 8 is a cross-sectional view showing a frost drying unit of an infrared sensor of the concentration cooling apparatus in accordance with another embodiment of the present invention.

The frost drying unit in accordance with another embodiment has a structure that a frost drying unit is installed in case the movement of nozzle in the radius direction is performed in the different direction.

In the nozzle 80 of another embodiment, a connection rod 82 for rotating the nozzle 80 in the direction of the radius is vertically installed to the above connection rod 32.

The frost drying unit includes an infrared transmission window 84 which is attached on the front surface of the nozzle 80 to cover the sensor receiving groove 36 in which the infrared sensor 26 is received, and a frost drying member 86 for drying frost attached on the surface of the infrared transmission window 84 when the nozzle 80 rotates in the direction of the radius.

Here, the end portion which is contacted on the infrared transmission window 84 is positioned vertically to the direction of the diameter of the nozzle 80 and dries frost condensed on the infrared transmission window 84 when the nozzle 80 rotates in the direction of the diameter.

The frost drying unit can be varied by differently positioning the frost drying member for cleaning the surface of the infrared transmission window according to the direction of rotation of the nozzle.

The effect of the concentration cooling apparatus and the refrigerator having it of the present invention with the above composition and operation will be described.

The infrared transmission window is attached on the surface of the nozzle where the infrared sensor for sensing the high temperature load, and the frost drying member is positioned to be contacted on the surface of the infrared transmission window. In case the frost is condensed on the infrared transmission window by opening and closing the door of the refrigerator, when the nozzle is rotated in the direction of the diameter, the frost condensed on the infrared transmission window can be dried by the frost drying member, thus to improve reliability of the infrared sensor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A concentration cooling apparatus for a refrigerator, comprising:

a housing which is mounted in a cold air guiding path;

a nozzle which is rotatable supported in the housing, for concentratedly injecting cold air to a region where a high temperature load is generated when the high temperature load is generated in a predetermined region inside a cooling chamber;

an infrared sensor which is mounted at a front of the nozzle, for sensing the region where the high temperature load is generated, the infrared sensor rotating together with the nozzle; and a frost drying unit which is installed on an upper surface of the nozzle, for drying frost attached on a surface of the infrared sensor.

2. The apparatus of claim 1, wherein the nozzle includes a cold air injection port for injecting cold air, supplied to the cold air guiding path, to the region where the high temperature load is generated, and a sensor receiving groove for receiving the infrared sensor therein.

3. The apparatus of claim 1, wherein a connection rod is connected to both sides of the nozzle, the connection rod being connected to a nozzle driving portion, and the nozzle rotates in a predetermined direction when the nozzle driving portion is operated.

4. The apparatus of claim 2, wherein the frost drying unit includes:

an infrared transmission window which is attached on a surface of the nozzle, for covering the sensor receiving groove;

a frost drying member which is positioned to contact a surface of the infrared transmission window, for drying frost on the surface of the infrared transmission window when the nozzle rotates; and a controller that rotates the nozzle when frost is on the infrared transmission window.

5. The apparatus of claim 4, wherein the infrared transmission window is formed in an arc shape so that the infrared transmission window can extend along the surface of the nozzle, and a through hole is formed so that cold air can pass a portion where the cold air injection port is formed.

6. The apparatus of claim 4, wherein the frost drying member, that contacts the surface of the infrared transmission window, is fixed on an inner wall of the cooling chamber, and an end portion contacting the infrared transmission window is formed of to have a concave surface configured to abut the surface of the infrared transmission window.

7. The apparatus of claim 4, wherein an end portion contacting the infrared transmission window of the frost drying member is formed with a rubber material which can dry frost by abutting the surface of the infrared transmission window.

8. The apparatus of claim 6, wherein the end portion contacting the infrared transmission window of the frost drying member comprises a material having a predetermined elasticity.

9. The apparatus of claim 4, wherein an end portion contacting the infrared transmission window of the frost drying member extends in a direction transverse with respect to a rotation direction of the nozzle.

10. The apparatus of claim 4, wherein the controller includes:

a door opening/closing sensor that senses whether a door of the refrigerator is opened or closed; and a control unit that rotates the nozzle by driving a nozzle driving portion in accordance with an electric signal supplied from the door opening/closing sensor.

* * * * *

UNITED STATES PATENT AND TRADEMARK OFFICE

CERTIFICATE OF CORRECTION

PATENT NO. : 6,718,780 B2
DATED : April 13, 2004
INVENTOR(S) : S. Cho et al.

It is certified that error appears in the above-identified patent and that said Letters Patent is hereby corrected as shown below:

Column 7,
Line 2, “rotatable” should be -- rotatably --.

Column 8,
Line 10, after “formed” delete “of”.

Signed and Sealed this

Fourteenth Day of December, 2004

JON W. DUDAS
*Director of the United States Patent and Trademark Office*